US009200584B2

(12) United States Patent
Jung et al.

(10) Patent No.: US 9,200,584 B2
(45) Date of Patent: Dec. 1, 2015

(54) METHOD AND DEVICE FOR OPERATING AN INTERNAL COMBUSTION ENGINE

(75) Inventors: Uwe Jung, Wörth a. d. Donau (DE); Gerd Rösel, Regensburg (DE); Hong Zhang, Tegernheim (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 605 days.

(21) Appl. No.: 13/148,349

(22) PCT Filed: Jan. 25, 2010

(86) PCT No.: PCT/EP2010/050794

§ 371 (c)(1),
(2), (4) Date: Aug. 8, 2011

(87) PCT Pub. No.: WO2010/089219

PCT Pub. Date: Aug. 12, 2010

(65) Prior Publication Data

US 2011/0308499 A1 Dec. 22, 2011

(30) Foreign Application Priority Data

Feb. 6, 2009 (DE) ..... 10 2009 007 792

(51) Int. Cl.
*F02D 41/26* (2006.01)
*F02D 41/24* (2006.01)

(52) U.S. Cl.
CPC ..... *F02D 41/26* (2013.01); *F02D 41/2425* (2013.01); *F02D 41/2496* (2013.01)

(58) Field of Classification Search
CPC . F02D 41/24; F02D 41/2403; F02D 41/2406; F02D 41/28; F02D 41/34; F02D 41/345; B60W 10/06
USPC ..... 123/478, 480, 486, 487, 488; 701/102, 701/103, 104, 115
See application file for complete search history.

(56) References Cited

U.S. PATENT DOCUMENTS 3,702,601 A * 11/1972 Gordon et al. ..... 123/490
4,387,429 A * 6/1983 Yamauchi et al. ..... 701/105

(Continued)

FOREIGN PATENT DOCUMENTS

DE 10033343 A1 1/2002 ..... F02D 41/20
DE 102007005361 B3 10/2008 ..... F02D 41/00

(Continued)

OTHER PUBLICATIONS

International Search Report and Written Opinion for Application No. PCT/EP2010/050794 (14 pages), Apr. 29, 2010.

*Primary Examiner* — Hieu T Vo
*Assistant Examiner* — Sherman Manley
(74) *Attorney, Agent, or Firm* — Slayden Grubert Beard PLLC

(57) ABSTRACT

Each cylinder bank of the internal combustion engine is assigned in each case one injection event memory (EES), an injection determining process (EEP) and an injection execution process (EAP). In the respective injection determining process (EEP), desired injection events (EE) are determined for the associated cylinder bank. These injection events are stored in succession in the respectively associated injection event memory (EES). In the respective injection execution process (EAP), injection events (EE) are retrieved in succession from the associated injection event memory (EES) and executed in a sequence in which they were stored in the associated injection event memory (EES) by the associated injection determining process (EEP) (FIFO: first in first out). The in each case next injection event (EE) is executed only after the end of an execution of the in each case previously executed injection event (EE).

17 Claims, 2 Drawing Sheets

(56) References Cited

U.S. PATENT DOCUMENTS

| | | | | |
|---|---|---|---|---|
| 4,688,536 | A * | 8/1987 | Mitsuyasu et al. | 123/490 |
| 5,245,324 | A * | 9/1993 | Jonker et al. | 345/440.1 |
| 5,247,287 | A * | 9/1993 | Jonker et al. | 345/440.1 |
| 5,325,836 | A * | 7/1994 | Orzel et al. | 123/478 |
| 5,608,388 | A * | 3/1997 | Nakajima | 340/9.1 |
| 5,812,833 | A * | 9/1998 | Goler et al. | 713/502 |
| 5,951,619 | A * | 9/1999 | Merl et al. | 701/115 |
| 6,044,823 | A * | 4/2000 | Watanabe | 123/490 |
| 6,374,801 | B1 * | 4/2002 | Haussmann et al. | 123/406.65 |
| 6,564,771 | B2 * | 5/2003 | Rueger et al. | 123/299 |
| 6,672,278 | B2 | 1/2004 | Zimmermann et al. | 123/299 |
| 6,865,473 | B2 * | 3/2005 | Moessinger et al. | 701/114 |
| 6,983,731 | B2 | 1/2006 | Rohatschek et al. | 123/299 |
| 7,395,807 | B2 * | 7/2008 | Watanabe | 123/305 |
| 2002/0046731 | A1 * | 4/2002 | Rueger et al. | 123/299 |
| 2003/0029417 | A1 | 2/2003 | Zimmermann et al. | F02D 45/00 |
| 2005/0229898 | A1 * | 10/2005 | Kikutani et al. | 123/299 |
| 2005/0235965 | A1 * | 10/2005 | Rohatschek et al. | 123/490 |
| 2006/0009902 | A1 * | 1/2006 | Song et al. | 701/103 |
| 2009/0078234 | A1 * | 3/2009 | Barrett et al. | 123/406.37 |
| 2010/0059020 | A1 * | 3/2010 | Serai et al. | 123/458 |
| 2010/0114459 | A1 | 5/2010 | Engelmann et al. | F02D 41/40 |
| 2011/0308499 | A1 * | 12/2011 | Jung et al. | 123/478 |
| 2013/0226438 | A1 * | 8/2013 | Schroeder et al. | 701/104 |

FOREIGN PATENT DOCUMENTS

| | | | | |
|---|---|---|---|---|
| EP | 1403495 | A2 | 3/2004 | F02D 41/26 |
| EP | 1497544 | B1 | 1/2006 | F02D 41/20 |
| EP | 1835161 | A2 | 9/2007 | F02D 41/36 |
| JP | 60111040 | A | 6/1985 | F02D 41/26 |
| WO | 02/14670 | A1 | 2/2002 | F02D 41/38 |
| WO | 2010/089219 | A1 | 8/2010 | F02D 41/24 |

* cited by examiner

METHOD AND DEVICE FOR OPERATING AN INTERNAL COMBUSTION ENGINE

CROSS-REFERENCE TO RELATED APPLICATIONS

This application is a U.S. National Stage Application of International Application No. PCT/EP2010/050794 filed Jan. 25, 2010, which designates the United States of America, and claims priority to German Application No. 10 2009 007 792.8 filed Feb. 6, 2009, the contents of which are hereby incorporated by reference in their entirety.

TECHNICAL FIELD

The invention relates to a method and a device for operating an internal combustion engine, and in particular for controlling an injection of fuel.

BACKGROUND

DE 10 2007 005 361 B3 discloses a device and a method for controlling the injection of fuel. Injectors are actuated sequentially, according to actuation data for opening and closing, in injection processes, wherein for each cylinder, a certain injection segment in a working cycle is defined in which injections are possible. For the cylinders, per injection segment, a plurality of injection processes are executed whose duration and time in the working cycle are predefined. For each cylinder, successive injection processes are combined into a plurality of packets whose injection processes are executed in direct succession. For the injection of fuel, the packets are processed in a sequence in which packets of different cylinders are in direct succession. For this purpose, a distribution step is provided in which injection processes are distributed between the packets, with no consideration being given here to an undesired overlap of packets of different injection segments or cylinders. Furthermore, a collision correction step is provided in which a shift or suppression of at least partially overlapping and therefore colliding injection processes is carried out.

EP 1 497 544 B1 discloses a method for operating a fuel injection system for an internal combustion engine. Flank overlaps are determined during static and dynamic interrupts of an actuation circuit during the operation of the injection system. Said determination takes place as a function of the rotational speed and the crankshaft angle of the internal combustion engine. Individual flank times are inspected for overlap in pairs.

DE 100 33 343 A1 discloses a fuel injection system for an internal combustion engine. The fuel injection system has injection regulation for the monitoring and/or resolution of a conflict during the actuation of actuator elements. The actuator elements are piezoelectric elements or solenoid valves. Injections are assigned different priorities, as a result of which conflict situations are resolved. If conflict occurs between two injections, the injection with the lower priority is shifted.

SUMMARY

According to various embodiments, a simple and reliable method for operating an internal combustion engine can be provided. According to further embodiments, a device for operating an internal combustion engine can be provided, which device permits simple and reliable operation of the internal combustion engine.

According to an embodiment, a method for operating an internal combustion engine which has at least one cylinder bank with at least two cylinders to which is assigned in each case at least one injection valve, and each cylinder bank is assigned in each case one injection event memory, an injection determination process and an injection execution process, may comprise:—in the respective injection determination process, desired injection events for the associated cylinder bank are determined and these are stored in succession in the respectively associated injection event memory, and,—in the respective injection execution process, injection events are retrieved in succession from the associated injection event memory and are processed in a sequence in which they were stored in the associated injection event memory by the associated injection determination process, and the next injection event in each case is processed only after an execution of the in each case previously executed injection event has ended.

According to a further embodiment, the processing may comprise, in a first case, executing the respective injection event in a respective desired time segment determined in the associated injection determination process if a start of said time segment has not yet passed, and otherwise, in a second case, executing the respective injection event only after the execution of the in each case previously executed injection event has ended, or not executing the respective injection event. According to a further embodiment, in the second case, the respective injection event can be executed immediately after the execution of the in each case previously executed injection event has ended. According to a further embodiment, the respective injection event which can be executed in each case maintaining injection parameters determined in the associated injection determination process. According to a further embodiment,—during the course of the respective injection determination process, each injection event can be determined in a determination step executed in each case, and the injection event determined in each case is stored, in a storage step executed in each case, in the associated injection event memory, and,—during the course of the respective injection execution process, each injection event can be retrieved, in a retrieval step executed in each case, from the associated injection event memory, and the injection event retrieved in each case is processed in a processing step executed in each case.

According to another embodiment, a device for operating an internal combustion engine which has at least one cylinder bank with at least two cylinders to which is assigned in each case at least one injection valve, and each cylinder bank is assigned in each case one injection event memory, an injection determination process and an injection execution process, can be designed—to determine desired injection events for the associated cylinder bank in the respective injection determination process and to store said injection events in succession in the respectively associated injection event memory, and—to retrieve and process injection events in succession from the associated injection event memory in the respective injection execution process in a sequence in which said injection events were stored in the associated injection event memory by the associated injection determination process, and to process the next injection event in each case only after an execution of the in each case previously executed injection event has ended. According to a further embodiment of the device, the respective injection event memory can be designed as a FIFO memory.

BRIEF DESCRIPTION OF THE DRAWINGS

Exemplary embodiments will be explained below on the basis of the schematic drawings, in which.

Elements of identical design or function are provided with the same reference symbols throughout the figures.

DETAILED DESCRIPTION

Figure 1:
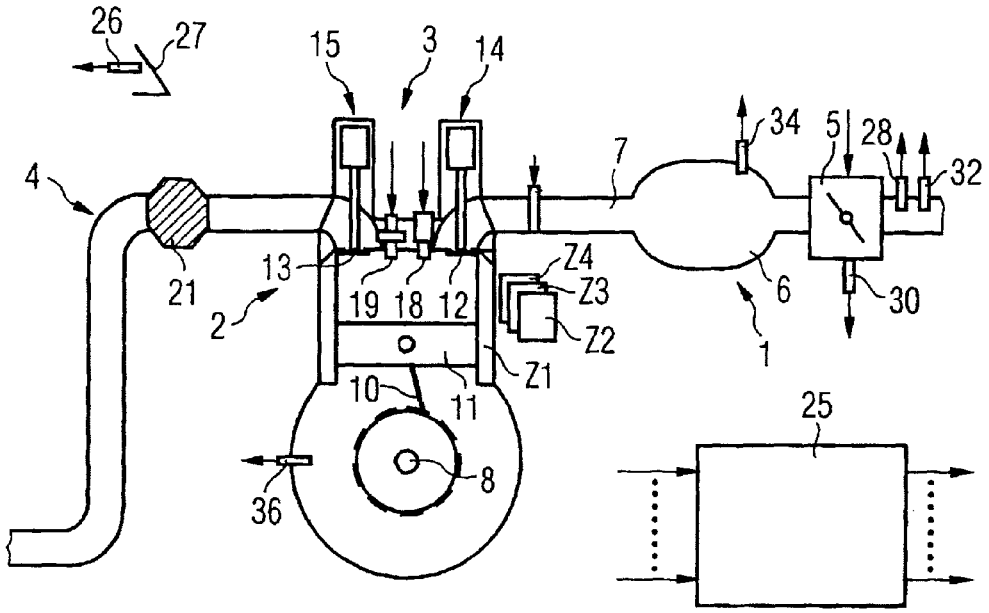
FIG. 1 shows an internal combustion engine having a control device.

According to various embodiments, in a method and a corresponding device for operating an internal combustion engine which has at least one cylinder bank with at least two cylinders to which is assigned in each case at least one injection valve, each cylinder bank is assigned in each case one injection event memory, an injection determination process and an injection execution process. In the respective injection determination process, desired injection events for the associated cylinder bank are determined. These are stored in succession in the respectively associated injection event memory. In the respective injection execution process, injection events are retrieved in succession from the associated injection event memory and are processed in a sequence in which they were stored in the associated injection event memory by the associated injection determination process. The next injection event in each case is processed only after an execution of the in each case previously executed injection event has ended.

The advantage is that this is very simple and the internal combustion engine can therefore also be operated in a very reliable and robust manner. Desired injection events which overlap in terms of time are always executed in succession as a result of the processing of the injection events in the sequence in which they were stored in the associated injection event memory by the associated injection determination process, and as a result of the fact that the next injection event in each case is processed only after the execution of the in each case previously executed injection event has ended; that is to say, the overlap is resolved in a simple and reliable manner without it being necessary for injection events to be actively checked for overlap and to be actively shifted in terms of time if overlap is detected. The next injection event in each case is preferably also retrieved from the associated injection event memory only after the execution of the in each case previously executed injection event has ended.

The respective injection determination process and the respective injection execution process are preferably executed independently of one another, that is to say they are preferably executed as mutually separate processes which are preferably coupled to one another unidirectionally only via the associated injection event memory. The respective injection determination process and the respective injection execution process may however also be configured differently.

The execution of an injection event represents an actual injection process, that is to say comprises an actuation of the respective injection valve such that the latter is opened and fuel can be metered into the respective cylinder.

In an embodiment, the processing comprises, in a first case, executing the respective injection event in a respective desired time segment determined in the associated injection determination process if a start of said time segment has not yet passed. The processing otherwise comprises, in a second case, executing the respective injection event only after the execution of the in each case previously executed injection event has ended, or not executing the respective injection event. This has the advantage of being very simple. Since the respective injection event is processed only after the execution of the in each case previously executed injection event has ended, the respective injection event, when it is executed, is executed only after the execution of the in each case previously executed injection event has ended, as a result of which the overlap of the desired time segments provided for the respective execution is automatically resolved. Alternatively, in the second case, the respective injection event is not executed, as a result of which the overlap of the desired time segments provided for the respective execution is likewise automatically resolved.

In this connection, it is advantageous if, in the second case, the respective injection event is executed immediately after the execution of the in each case previously executed injection event has ended. In this way, in the second case, the respective injection event is executed as close as possible in terms of time to the desired time segment. Furthermore, the overall fuel quantity metered into the respective cylinder may thus correspond to a desired fuel quantity.

In one embodiment, the respective injection event which is executed is executed in each case maintaining injection parameters determined in the associated injection determination process. This has the advantage that the injection execution process can be made very simple and reliable in this way. Injection parameters encompass in particular an injection duration, that is to say for example a time duration of the desired time segment, or a fuel quantity to be metered. In particular, the respective injection event is preferably neither shortened nor divided into two or more than two injection events.

In one embodiment, during the course of the respective injection determination process, each injection event is determined in a determination step executed in each case. The injection event determined in each case is stored, in a storage step executed in each case, in the associated injection event memory. During the course of the respective injection execution process, each injection event is retrieved, in a retrieval step executed in each case, from the associated injection event memory. The injection event retrieved in each case is processed in a processing step executed in each case. The advantage is that this is very simple and permits particularly reliable and robust operation of the internal combustion engine. Furthermore, in this way, the processing sequence of the injection events is obtained in a very simple manner.

In one embodiment of the device, the respective injection event memory is designed as a FIFO memory. The advantage is that this is very simple and cheap. The FIFO memory is operated according to the "first in-first out" principle, or FIFO for short. In this way, injection events stored in the FIFO memory can be retrieved again from the latter only in the sequence in which they were previously stored therein.

An internal combustion engine comprises an intake tract 1, an engine block 2, a cylinder head 3 and an exhaust tract 4 (FIG. 1). The intake tract 1 comprises preferably a throttle flap 5, a manifold 6 and an intake pipe 7 which leads to a cylinder Z1 via an inlet duct into a combustion chamber of the engine block 2. The engine block 2 also comprises a crankshaft 8 which is coupled via a connecting rod 10 to a piston 11 of the cylinder Z1. In addition to the cylinder Z1, the internal combustion engine comprises at least one further cylinder Z2 and preferably further cylinders Z3, Z4, though may also comprise any desired greater number of cylinders Z1-Z4. The internal combustion engine is preferably arranged in a motor vehicle.

The cylinder head 3 comprises a valve drive 14, 15 which is coupled to a gas inlet valve 12 and a gas outlet valve 13. The valve drive 14, 15 comprises at least one camshaft which is coupled to the crankshaft 8. Also arranged in the cylinder head 3 is an injection valve 18 and, if the internal combustion engine is not a diesel internal combustion engine, possibly a spark plug 19. Alternatively, the injection valve 18 may also be arranged in the intake pipe 7. An exhaust-gas catalytic converter 21 designed preferably as a three-way catalytic converter is arranged in the exhaust tract 4.

A control device 25 is provided, to which control device are assigned sensors which detect different measurement variables and determine in each case the measured value of the measurement variable. As a function of at least one of the measurement variables, the control device 25 determines actuating variables which are then converted into one or more actuating signals for controlling the actuating elements by means of corresponding actuating drives. The control device 25 also determines characteristic values of characteristic variables. The characteristic variables may be measurement variables or variables derived therefrom. The control device is designed to determine injection events EE and execute these by generating corresponding actuating signals, in particular for the respective injection valve 18. The control device 25 may also be referred to as a device for controlling the internal combustion engine, and/or as an engine controller. The sensors are for example a pedal position transducer 26 which detects an accelerator pedal position of an accelerator pedal 27, an air mass sensor 28 which detects an air mass flow upstream of the throttle flap 5, a temperature sensor 32 which detects an intake air temperature, a throttle flap position sensor 30 which detects a degree of opening of the throttle flap 5, an intake pipe pressure sensor 34 which detects an actual value of an intake pipe pressure in the manifold 6, and a crankshaft angle sensor 36 which detects a crankshaft angle, to which a rotational speed of the internal combustion engine is then assigned.

Depending on the embodiment, any desired subset of said sensors may be provided, or additional sensors may also be provided.

The actuating elements are for example the throttle flap 5, the gas inlet and gas outlet valves 12, 13, the injection valve 18 and possibly the spark plug 19.

The actuating elements and sensors may in each case be assigned to only one cylinder Z1-Z4 and/or may in each case be assigned to a plurality of cylinders Z1-Z4. If an actuating element and/or a sensor is assigned to a plurality of cylinders Z1-Z4, the actuating signals or measured values for the actuating element or the sensor are assigned to the individual cylinders Z1-Z4 for example as a function of the crankshaft angle.

The control device 25 preferably has at least one electrical output stage for providing an injection actuating signal for in each case at least two of the cylinders Z1-Z4. Here, the cylinders 21-24 may be assigned in each case to one of two or even more than two cylinder banks. Each cylinder bank is then preferably assigned in each case one electrical output stage of the control device 25 for the provision of an injection actuating signal for the cylinders Z1-Z4 assigned to the respective cylinder bank, that is to say all the cylinders of a respective cylinder bank are actuated by the same electrical output stage. Each bank then preferably comprises at least two of the cylinders Z1-Z4.

Because a crankshaft angle range which is used for injections of a respective one of the cylinders Z1-Z4 may be greater than a respective working cycle, conflicts may arise in that it is sought to carry out injections with a time overlap by means of two injection valves 18 actuated by the same output stage. In the case of 4-cylinder engines, said crankshaft angle range is for example up to 270 degrees.

Figure 2:
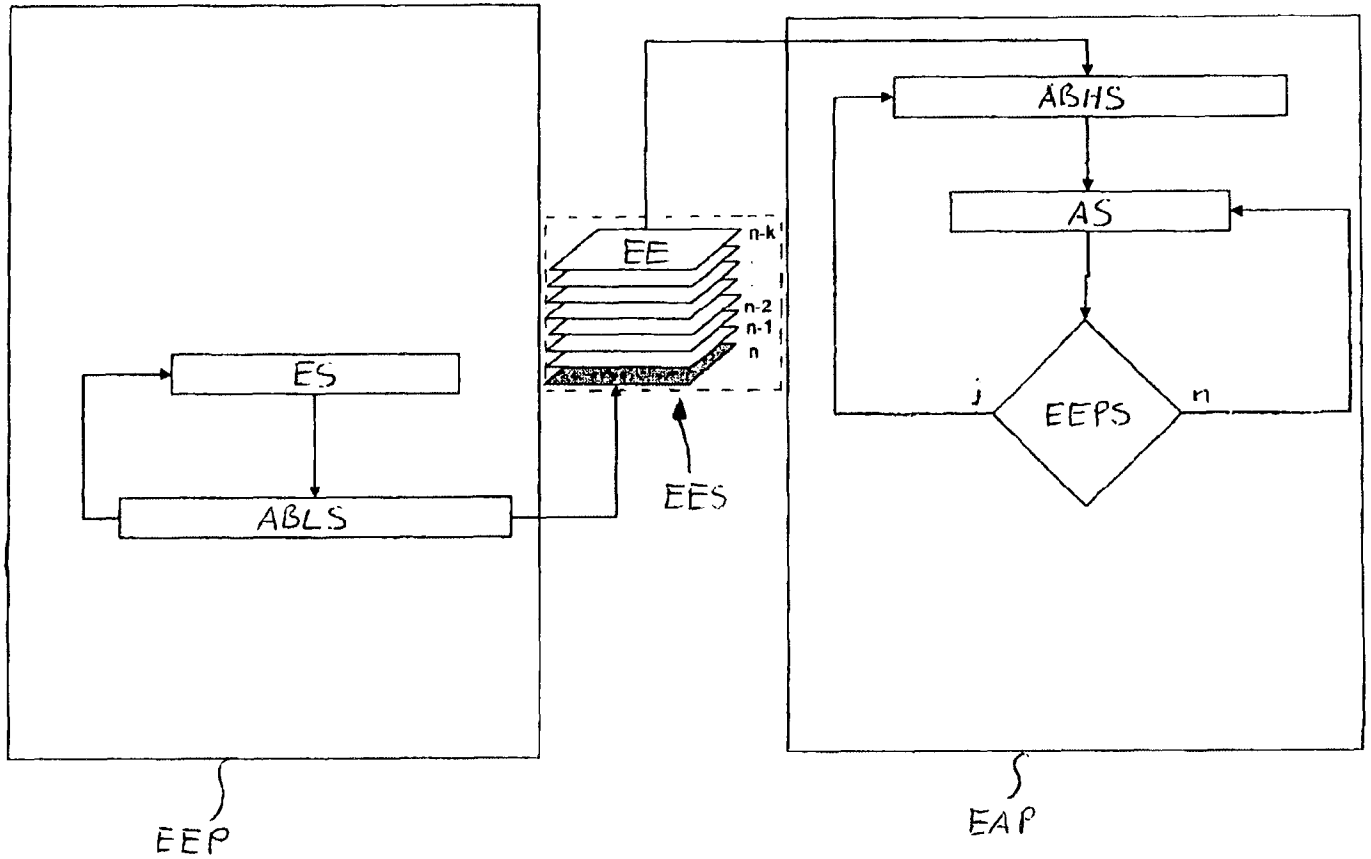
FIG. 2 shows a block diagram.

FIG. 2 shows a block diagram of a program for operating the internal combustion engine, which program can preferably be executed by the control device 25. The program comprises an injection determination process EEP, an injection event memory EES and an injection execution process EAP. In each case one such program is preferably provided for each cylinder bank.

The respective injection determination process EEP comprises a determination step ES for determining injection events EE to be executed by a respective cylinder Z1-Z4 of the associated cylinder bank. The determination of the injection events EE takes place preferably as a function of measurement variables, for example as a function of the rotational speed of the internal combustion engine. The determination of the injection events EE also takes place preferably without prioritization, that is to say the different injection events EE preferably do not have any execution priority, such that no injection event EE can be favored more or less than another on account of differently assigned priorities. The determination of the injection events EE may however also take place in some other way. The respective injection determination process EEP also comprises a storage step ABLS for the storage of the respective determined injection event EE in the associated injection event memory EES. After the storage of the respective injection event EE, the injection determination process EEP continues with the determination step ES in which the next injection event EE in each case is determined.

The respective injection event EE comprises in particular items of information regarding a desired time segment in which the injection event EE should be executed, that is to say in which the injection should take place. The desired time segment is predefined for example in the form of a crankshaft angle at which the injection should start, and an injection duration or a crankshaft angle at which the injection should end. The desired time segment may however be predefined in some other way.

The injection event memory EES is designed preferably as a FIFO memory, which is operated according to the "first in-first out" principle, or FIFO for short. The injection event memory EES may also be referred to as a queue or as a queue memory. A sequence of the injection events EE in which the injection events EE are retrieved from the injection event memory EES therefore corresponds to a sequence of the injection events EE in which the injection events EE were previously stored in the injection event memory EES.

The respective injection execution process EAP comprises a retrieval step ABHS for retrieving in each case one injection event EE from the injection event memory EES. The retrieved injection event EE is processed in a processing step AS. The processing generally comprises the execution of the retrieved injection event EE. The execution of the respective injection event EE comprises in particular the generation of the injection actuating signal, that is to say the actuating signal for the injection valve 18 by means of which the injection is to take place. In the execution of the injection event EE, consideration is given in particular basically to the desired time segment in which the injection should take place, that is to say in particular the desired start of injection and the desired injection duration or the desired end of injection.

Provision may be made for the execution of the respective injection event EE to be dispensed with, in particular if, at a time of an actual possible start of the injection, a time of the desired start of injection as previously determined in the determination step ES for said injection event EE has already passed. For this purpose, in the processing step AS, it may be checked whether the desired start of injection for the most recently retrieved injection event EE has already passed. If this is the case, then the injection event EE is not executed; said injection event is otherwise executed preferably in the desired time segment. It may however likewise be provided, for example, that the execution of the respective injection event EE be dispensed with only if for example the desired end of injection thereof has already passed.

The respective injection event EE is however preferably executed regardless of whether the desired start of injection thereof or the desired end of injection thereof has already passed. In a first case, the respective injection event EE is executed in the respective desired time segment determined in the associated injection determination process EEP, if the start of said time segment has not already passed. Otherwise, that is to say if the start of the desired time segment has already passed, in a second case, the respective injection event EE is executed only after the execution of the in each case previously executed injection event EE has ended.

In an end of injection checking step EEPS, it is checked whether the presently executed injection event EE has come to an end, that is to say has been processed to completion. If this is not the case, that is to say the injection event EE is presently still being processed, then said injection event EE continues to be processed in the processing step AS. In particular, said injection event EE continues to be executed in the processing step AS. However, if no injection event EE is presently being processed and in particular executed, then the program is continued in the retrieval step ABHS in which the next injection event EE in each case is retrieved from the injection event memory EES. It is thus preferable for never more than one injection event EE to be processed, and therefore also for never more than one injection event EE to be executed, in the injection execution process EAP. A possible time overlap of the respective desired time segments of two successive injection events EE is thereby automatically resolved, without it being necessary for the injection events EE to be checked for the presence of such an overlap and actively shifted in time or shortened or split up. Furthermore, the injection events EE also need not have different execution priorities in order to resolve the overlap. The program thus permits very simple, reliable and robust operation of the internal combustion engine.

Figure 3:
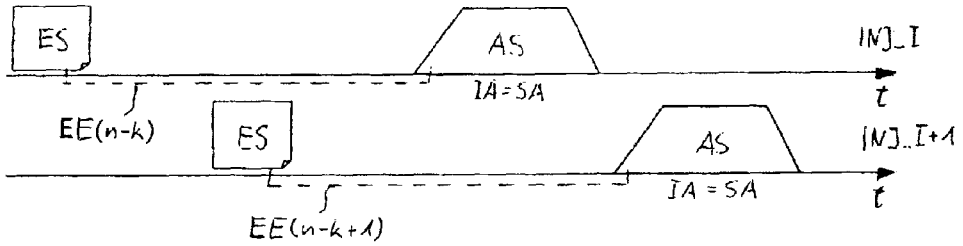
FIG. 3 shows a first example of two injection events.

FIG. 3 shows an example of a chronological profile of the determination step ES and of the processing step AS for two injection valves 18 which are assigned to the same cylinder bank and which are referred to as first injector INJ_I and second injector INJ_I+1. Here, the determination step ES and processing step AS relating to the first injector INJ_I are illustrated in the top time bar and the determination step ES and processing step AS relating to the second injector INJ_I+1 are illustrated in the lower time bar. In the determination step ES relating to the first injector INJ_I, a first injection event EE(n−k) is determined and stored in the injection event memory EES. In the determination step ES relating to the second injector INJ_I+1, a second injection event EE(n−k+1) is determined and stored in the injection event memory EES. In the processing step AS relating to the first injector INJ_I, the first injection event EE(n−k) is retrieved from the injection event memory EES and executed in the desired time segment, because no other injection event EE is being executed at the desired start of injection. In the processing step AS relating to the second injector INJ_I+1, the second injection event EE(n−k+1) is retrieved from the injection event memory EES and executed in the desired time segment, because no other injection event EE is being executed at the desired start of injection. In particular, at the desired start of injection of the second injection event EE(n−k+1), the first injection event EE(n−k) has already ended. In said first case, therefore, an actual execution IA of the first and of the second injection event EE(n−k), EE(n−k+1) corresponds to a setpoint execution SA of the respective injection event EE, that is to say the respective injection event EE is executed in each case in the desired time segment as determined and predefined in the respective determination step ES. The setpoint execution SA may also be referred to as an execution demand or desired execution, and corresponds in terms of time to the desired time segment. The actual execution IA may also be referred to as actual execution or injection.

Figure 4:
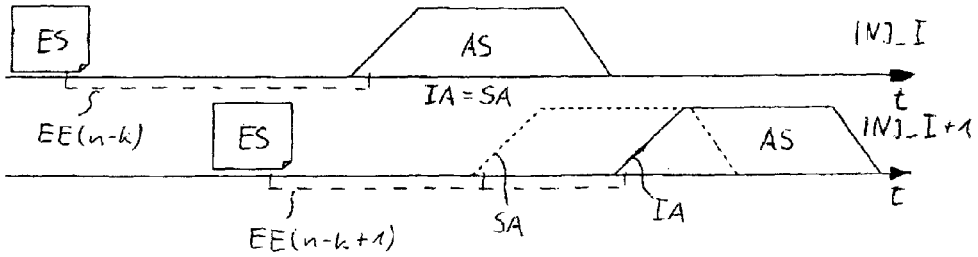
FIG. 4 shows a second example of two injection events.

FIG. 4 correspondingly shows an example of a chronological profile of the determination step ES and of the processing step AS in which there is a time overlap of the respective setpoint executions SA. In the determination step ES relating to the first injector INJ_I, the first injection event EE(n−k) is determined and stored in the injection event memory EES. In the determination step ES relating to the second injector INJ_I+1, the second injection event EE(n−k+1) is determined and stored in the injection event memory EES. In the processing step AS relating to the first injector INJ_I, the first injection event EE(n−k) is retrieved from the injection event memory EES and executed in the desired time segment, because no other injection event EE is being executed at the desired start of injection. This therefore corresponds to the first case, in which the actual execution IA coincides with the setpoint execution SA. In the processing step AS relating to the second injector INJ_I+1, the second injection event EE(n−k+1) is retrieved from the injection event memory EES. According to FIG. 2 and the above description, however, said retrieval takes place only after the execution of the first injection event EE(n−k) has ended. The second injection event EE(n−k+1) can therefore be processed and in particular executed at the earliest after the processing and in particular execution of the first injection event EE(n−k) has ended. In the example shown, however, the injection by means of the second injector INJ_I+1 should start earlier, specifically during the execution of the first injection event EE(n−k). The second injection event EE(n−k+1) is therefore not executed in the desired time segment but rather is executed only after the execution of the first injection event EE(n−k) has ended. In said second case, therefore, the actual execution IA takes place later than the setpoint execution SA.

It is preferably provided that the injection events EE are determined in the respective injection determination process EEP on a cylinder-by-cylinder basis in a chronological sequence of their respective desired time segment. For example, the cylinder bank has only the first injector INJ_I and the second injector INJ_I+1. Then, for example, for each cycle, all of the injection events EE relating to the first injector INJ_I are determined in their chronological sequence and stored in the associated injection event memory EES, then all of the injection events EE relating to the second injector INJ_I+1 are determined in their chronological sequence and stored in the associated injection event memory EES. This is preferably repeated for each cycle during the operation of the internal combustion engine. The injection events EE may however also be determined in some other way.

The conflict in the case of injections which overlap in terms of time is resolved in a simple and robust manner through the provision of the respective injection event memory EES and of the respectively associated injection determination process EEP and injection execution process EAP. It is preferably provided that, in the second case too, the respective injection event EE is executed in each case maintaining injection parameters determined in the associated injection determination process EEP, in particular maintaining the desired injection duration. It may however also be provided that, in the second case, the injection event EE corresponding in each case to the second injection event EE(n−k+1) is shortened in terms of injection duration.

What is claimed is:

1. A method for operating an internal combustion engine having a cylinder bank with a plurality of cylinders, each cylinder having at least one assigned injection valve, and the cylinder bank having an assigned injection event memory, an injection determination process, and an injection execution process, the method comprising:

determining a plurality of desired injection events for the plurality of cylinders and storing the determined plurality of desired injection events in succession in the order in which the desired injection events were determined in the injection event memory, each desired injection event having a stored setpoint execution time, retrieving the desired injection events for the plurality of cylinders in succession from the injection event memory and processing the retrieved injection events in the sequence in which they were stored in the injection event memory, such that the desired injection events for the plurality of cylinders are stored and processed in a first-in-first-out (FIFO) manner, wherein each injection event in the sequence of injection events is retrieved from the injection event memory and processed independently of each other injection event, and wherein each injection event in the sequence of injection events is retrieved from the injection event memory and processed, including an analysis of the stored setpoint execution time for the injection event, only after completion of the previous injection event in the sequence, such that for a particular injection event having a stored setpoint execution time that overlaps with the ongoing execution of the previous injection event in the sequence, the analysis of the stored setpoint execution time for the particular injection event is not initiated, and the particular injection event is not executed, until after the ongoing execution of the previous injection event is complete.

2. The method according to claim wherein the processing comprises, in a first case, executing the respective injection event in a respective desired time segment determined in the associated injection determination process if a start of said time segment has not yet passed, and otherwise, in a second case, executing the respective injection event only after the execution of the in each case previously executed injection event has ended, or not executing the respective injection event.

3. The method according to claim 2, wherein, in the second case, the respective injection event is executed immediately after the execution of the in each case previously executed injection event has ended.

4. The method according to claim 2, wherein the respective injection event which is executed in each case maintaining injection parameters determined in the associated injection determination process.

5. The method according to claim 1, wherein, during the course of the respective injection determination process, each injection event is determined in a determination step executed in each case, and the injection event determined in each case is stored, in a storage step executed in each case, in the associated injection event memory, and, during the course of the respective injection execution process, each injection event is retrieved, in a retrieval step executed in each case, from the associated injection event memory, and the injection event retrieved in each case is processed in a processing step executed in each case.

6. A device for operating an internal combustion engine having a cylinder bank with a plurality of cylinders, each cylinder having at least one assigned injection valve, and the cylinder bank having an assigned injection event memory, an injection determination process, and an injection execution process, which device is configured:

to determine a plurality of desired injection events for the plurality of cylinders and to store said plurality of determined injection events in succession in the order in which the desired injection events were determined in the injection event memory, each desired injection event having a stored setpoint execution time, and to retrieve and process the desired injection events in succession from the injection event memory in the sequence in which said injection events were stored in the injection event memory by the injection determination process, wherein each injection event in the sequence of injection events is retrieved from the injection event memory and processed independently of each other injection event, and wherein each injection event in the sequence of injection events is retrieved from the injection event memory and processed, including an analysis of the stored setpoint execution time for the injection event, only after completion of the previous injection event in the sequence, such that for a particular injection event having a stored setpoint execution time that overlaps with the ongoing execution of the previous injection event in the sequence, the analysis of the stored setpoint execution time for the particular injection event is not initiated, and the particular injection event is not executed, until after the ongoing execution of the previous injection event is complete.

7. The device according to claim 6, wherein the respective injection event memory is designed as a FIFO memory.

8. The device according to claim 6, wherein the processing comprises, in a first case, executing the respective injection event in a respective desired time segment determined in the associated injection determination process if a start of said time segment has not yet passed, and otherwise, in a second case, executing the respective injection event only after the execution of the in each case previously executed injection event has ended, or not executing the respective injection event.

9. The device according to claim 8, wherein, in the second case, the respective injection event is executed immediately after the execution of the in each case previously executed injection event has ended.

10. The device according to claim 8, wherein the respective injection event which is executed in each case maintaining injection parameters determined in the associated injection determination process.

11. The device according to claim 6, wherein, during the course of the respective injection determination process, each injection event is determined in a determination step executed in each case, and the injection event determined in each case is stored, in a storage step executed in each case, in the associated injection event memory, and, during the course of the respective injection execution process, each injection event is retrieved, in a retrieval step executed in each case, from the associated injection event memory, and the injection event retrieved in each case is processed in a processing step executed in each case.

12. An internal combustion engine comprising a cylinder bank with a plurality of cylinders, each cylinder having at least one assigned injection valve, and the cylinder bank having an assigned injection event memory, an injection determination process, and an injection execution process, and a control device comprising a processor which is configured to:

determine a plurality of desired injection events for the plurality of cylinders and to store said plurality of determined injection events in succession in the order in which the desired injection events were determined in the injection event memory, each desired injection event having a stored setpoint execution time, and to retrieve and process the desired injection events in succession from the injection event memory in the sequence in which said injection events were stored in the injection event memory by the injection determination process, wherein each injection event in the sequence of injection events is retrieved from the injection event memory and processed independently of each other injection event, and wherein each injection event in the sequence of injection events is retrieved from the injection event memory and processed, including an analysis of the stored setpoint execution time for the injection event, only after completion of the previous injection event in the sequence, such that for a particular injection event having a stored setpoint execution time that overlaps with the ongoing execution of the previous injection event in the sequence, the analysis of the stored setpoint execution time for the particular injection event is not initiated, and the particular injection event is not executed, until after the ongoing execution of the previous injection event is complete.

13. The internal combustion engine according to claim 12, wherein the processing comprises, in a first case, executing the respective injection event in a respective desired time segment determined in the associated injection determination process if a start of said time segment has not yet passed, and otherwise, in a second case, executing the respective injection event only after the execution of the in each case previously executed injection event has ended, or not executing the respective injection event.

14. The internal combustion engine according to claim 13, wherein, in the second case, the respective injection event is executed immediately after the execution of the in each case previously executed injection event has ended.

15. The internal combustion engine according to claim 13, wherein the respective injection event which is executed in each case maintaining injection parameters determined in the associated injection determination process.

16. The internal combustion engine according to claim 12, wherein during the course of the respective injection determination process, each injection event is determined in a determination step executed in each case, and the injection event determined in each case is stored, in a storage step executed in each case, in the associated injection event memory, and, during the course of the respective injection execution process, each injection event is retrieved, in a retrieval step executed in each case, from the associated injection event memory, and the injection event retrieved in each case is processed in a processing step executed in each case.

17. The internal combustion engine according to claim 12, in which the respective injection event memory is designed as a FIFO memory.

* * * * *